US007642033B2

(12) United States Patent
Ikami et al.

(10) Patent No.: US 7,642,033 B2
(45) Date of Patent: Jan. 5, 2010

(54) TONER PRODUCTION METHOD, TONER AND TONER PRODUCTION APPARATUS

(75) Inventors: Jun Ikami, Ichinomiya (JP); Masateru Kawamura, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 602 days.

(21) Appl. No.: 11/354,877

(22) Filed: Feb. 16, 2006

(65) Prior Publication Data

US 2006/0183047 A1 Aug. 17, 2006

(30) Foreign Application Priority Data

Feb. 16, 2005 (JP) ..... 2005-039704

(51) Int. Cl.
*G03G 5/00* (2006.01)

(52) U.S. Cl. ..... 430/137.14; 430/137.1

(58) Field of Classification Search ..... 430/137.14, 430/137.1
See application file for complete search history.

(56) References Cited

U.S. PATENT DOCUMENTS 5,476,745 A 12/1995 Nakamura et al.
6,171,743 B1 1/2001 Nakamura
2004/0152006 A1* 8/2004 Teshima ..... 430/109.4

FOREIGN PATENT DOCUMENTS

| | | | |
|---|---|---|---|
| JP | H05-100485 | A | 4/1993 |
| JP | 1996034167 | A | 2/1996 |
| JP | 8 179553 | | 7/1996 |
| JP | 1999038674 | A | 2/1999 |
| JP | 1999143125 | A | 5/1999 |
| JP | 2000112170 | A | 4/2000 |
| JP | 2000267331 | A | 9/2000 |
| JP | 2004157267 | A | 6/2004 |
| JP | 2004-198598 | A | 7/2004 |
| JP | 2004-271816 | A | 9/2004 |

OTHER PUBLICATIONS

Japanese Patent Office, Office Action in Related Application No. JP 2005-039704, dated May 28, 2007.

* cited by examiner

*Primary Examiner*—Mark A Chapman
(74) *Attorney, Agent, or Firm*—Baker Botts L.L.P.

(57) ABSTRACT

In a toner production method, a volatile solvent gas is jetted into a dispersion of aggregated resin particles where at least resin particles dispersed in a continuous phase are aggregated. A form of the aggregated resin particles is controlled by jetting the volatile solvent gas into the dispersion of aggregated resin particles. The volatile solvent is removed from the form-controlled aggregated resin particles.

5 Claims, 2 Drawing Sheets

(A)

(B)

(C)

TONER PRODUCTION METHOD, TONER AND TONER PRODUCTION APPARATUS

CROSS REFERENCE TO RELATED APPLICATIONS

This application is based on and claims the benefit of priority from the prior Japanese Patent Application No. 2005-39704, filed on Feb. 16, 2005; the entire contents of which are incorporated herein by reference.

TECHNICAL FIELD

The present invention relates to a method of producing a toner used in the technical field of electrophotography, electrostatic recording, electrostatic printing, etc., to the toner produced according to the production method, and to an apparatus for producing the toner. In particular, the invention relates to a toner production method in which a form of the toner to be produced can be controlled to any desired form of from an amorphous form to a spherical form, efficiently and at low costs according to a simple operation even when a high-viscosity resin or a high-melting-point resin is used as a toner binder, and relates to a toner and to a toner production apparatus.

BACKGROUND

Heretofore, an emulsification and aggregation method is known as one example of toner production. The emulsification and aggregation method is for producing toner particles having a desired size by aggregating extremely fine resin particles in a solution (build-up production method), and this is excellent in that the toner particle size distribution can be sharp. Another advantage of the emulsification and aggregation method is that, since the resin viscosity of the aggregated resin particles can be controlled by utilizing the surface tension thereof, the form of the toner particles can be continuously controlled to any form of from an amorphous form to a spherical form (JP-A 8-179553).

For controlling the viscosity of the resin to be used as a toner binder herein, there are a method of utilizing heat and a method of using a solvent.

However, in the method of controlling the resin viscosity by utilizing the heat generated by heating the resin, the resin must be heated at a temperature not lower than the glass transition temperature (Tg) thereof when the resin particles are aggregated into spherical toner particles. Therefore, when a resin having a high melt viscosity is used, then it must be heated at an extremely high temperature, and in such a case, a specific apparatus such as a pressure apparatus is needed when the heating temperature therein is higher than the boiling point of water. This results in the increase in the production costs of the toner.

In the method of controlling the resin viscosity by using a resin, a diluted solvent must be added to the system and therefore a large-size reactor is needed, which, therefore reduces the toner production efficiency. When a solvent not diluted sufficiently is added, then the resin particles may mutually aggregate together and, after all, the form of the toner particles could not be controlled.

SUMMARY

The present invention has been made in view of the above circumstances and provides a toner production method in which a form of toner to be produced can be controlled to any desired form of from an amorphous form to a spherical form, efficiently and at low costs according to a simple operation even when a high-viscosity resin or a high-melting-point resin is used as a toner binder, and to provide a toner and a toner production apparatus.

According to an aspect, there is provided a toner production method which includes: jetting a volatile solvent gas into a dispersion of aggregated resin particles where at least resin particles dispersed in a continuous phase are aggregated; controlling a form of the aggregated resin particles by jetting the volatile solvent gas into the dispersion of aggregated resin particles; and removing the volatile solvent from the form-controlled aggregated resin particles.

According to another aspect, there is provide a toner production method includes: stirring and mixing at least a resin and a colorant in an organic solvent to prepare an oily phase where the resin and the colorant are dissolved and/or dispersed, adding a dispersion stabilizer and water to the oily phase; stirring and mixing the oily phase with the dispersion stabilizer and water to prepare a dispersion where a size of the droplet of the oily phase is smaller than a toner particle size; heating and stirring the dispersion to remove the organic solvent, thereby giving a dispersion of droplet-solidified, colorant-containing resin particles; forming a dispersion of aggregated resin particles where the colorant-containing resin particles dispersion is aggregated to be substantially a toner particle size, and jetting a volatile solvent gas into the dispersion of aggregated resin particles.

According to another aspect, a toner includes: a toner being produced by jetting a volatile solvent gas into a dispersion of aggregated resin particles where at least resin particles dispersed in a continuous phase are aggregated, to thereby control a form of the aggregated resin particles, and removing the volatile solvent from the form-controlled, aggregated resin particles.

According to an other aspect, a toner production apparatus includes: a first container where a dispersion of aggregated resin particles is prepared, in which at least resin particles dispersed in a continuous phase are aggregated; a second container where a volatile solvent is included to produce a volatile solvent gas in the second container; a first connecting duct that connects the first container and the second container, and a pump installed in the first connecting duct for jetting the volatile solvent gas from the second container into the aggregated resin particles dispersion in the first container.

BRIEF DESCRIPTION OF THE DRAWINGS

These and other objects and advantages of this invention will become more fully apparent from the following detailed description taken with the accompanying drawings in which.

DESCRIPTION OF ILLUSTRATIVE ASPECTS

Figure 1:
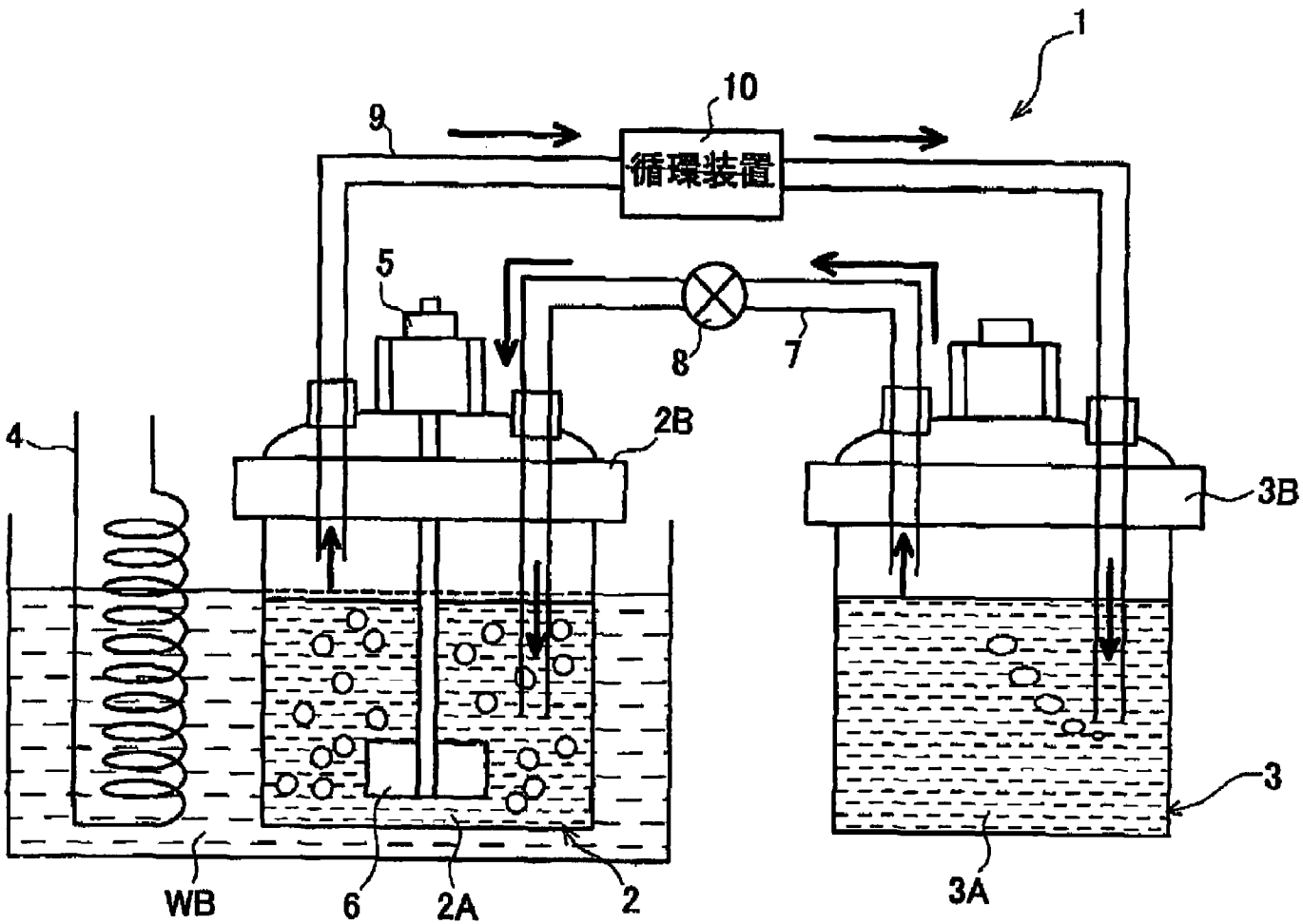
FIG. 1 is an explanatory view schematically showing a toner production method.

Illustrative aspects of both toner production method and a toner produced thereby will be described in detail hereinafter.

According to illustrative aspect, the toner production method is basically performed by jetting a volatile solvent gas into a dispersion of aggregated resin particles where at least resin particles dispersed in a continuous phase are aggregated, to thereby control the form of the aggregated resin particles, and removing the volatile solvent from the form-controlled, aggregated resin particles.

The continuous phase is water or an aqueous solution. For aggregating resin particles therein, an aggregating agent is added to it while the resin particles are dispersed and stabilized therein. The aggregating agent may be added to it while the resin particles dispersion (slurry) is stirred and kept dispersed or not. For forming a uniform system, the aggregating agent may be added while the slurry is stirred. An amount of the aggregating agent to be added may vary, depending on a type of the aggregating agent, and its optimum amount may be determined in consideration of the resin particles dispersion system.

Only when an aggregating agent is added and stirred, then the particles may aggregate and grow to those having a desired toner particle size, but the amount of the aggregating agent to be added may be reduced by heating the system. In addition, the heating operation may be effective for lowering the viscosity of a low-molecular-weight resin, whereby the aggregated particles may be partly fused and may be therefore prevented from being again decomposed into smaller particles in the subsequent dispersion stabilization operation. In this stage, the heating temperature is preferably higher than the glass transition point of the resin by at least 10° C. Too strongly or too weakly stirring the system in the aggregation step is inappropriate. If the stirring condition is too strong, then the aggregated particles may collide or may undergo shear fracture; but if too weak, then the system could not flow as a whole and the aggregated particle size may therefore fluctuate.

The aggregated resin particles prepared by aggregating resin particles and growing them to those having a desired toner particle size must be controlled by the use of a dispersion stabilizer added thereto so that they should not undergo any further unnecessary aggregation growth. The amount of the dispersion stabilizer to be added may vary depending on the type thereof, and its optimum amount may be determined in consideration of the resin particles dispersion system. The stabilizer may be added with or without stirring the system. However, for rapidly stopping the aggregation growth, the stabilizer is preferably added with stirring. The dispersion stabilization operation may comprise the addition of a dispersion stabilizer alone, or may comprise any additional step. For example, the stirring speed or the stirring method may be changed, or ultrasonic waves may be applied to the system.

For vaporizing a volatile solvent by jetting it into the aggregated resin particles dispersion, a method is effective that comprises jetting air into the volatile solvent at room temperature (25° C.) and under normal pressure so as to take out the solvent gas from the vapor phase part. When a volatile solvent having a high boiling point is used or as an operation for generating a large quantity of volatile gas, overheating may be effective. However, temperature control is desired so that the volatile gas is not liquefied before it is jetted into the aggregated resin particles dispersion. In addition, when the affinity between the resin and the volatile solvent is high, then the resin viscosity may lower relatively rapidly owing to the combination of heating and use of the volatile solvent gas, and in such a case, form control except for spheres may be difficult.

For making the volatile solvent gas, which has been fed to the aggregated resin particles dispersion, absorbed by water or by the aggregated resin particles, it is desirable that the gas may stay as fine bubbles thereof in the dispersion for a long period of time. Some methods for forming bubbles of the volatile solvent gas may be employed herein. The gas-feeding duct inserted into the dispersion may be curved or holed so that the volatile solvent gas may be jetted out through plural portions of the duct, or a porous material may be disposed around the gas-jetting out port, or ultrasonic waves may be applied to the jetted gas.

For making the bubbles of the volatile solvent gas stay in the aggregated resin particles dispersion for a long period of time, there may be employed a method of suitably controlling and determining the number, the moving speed, the shape and the positioning configuration of the stirring blades and the baffles to be used in the system. For jetting the volatile solvent gas into the system, herein employable are fans, pumps, pressure cylinders, vacuum cylinders or the like, via which the inner pressure of the volatile solvent container is increased or reduced and the volatile solvent gas is thereby jetted from its container to the container of aggregated resin particles dispersion. For efficiently transferring the volatile solvent gas at room temperature and under normal pressure, preferred is a circulation system where the volatile solvent gas discharged out of the container of aggregated resin particles dispersion is again circulated into the container of volatile solvent. For controlling the concentration of the volatile solvent gas, an airflow control valve may be fitted to the system. Except the volatile solvent gas, herein employable is an inert gas such as nitrogen gas not soluble in water and not reactive with toner, in addition to air.

As so mentioned hereinabove, when a volatile solvent gas is jetted into a dispersion of aggregated resin particles and when it passes through the dispersion, then the volatile solvent is caught by the aggregated resin particles that have high compatibility with it. Accordingly, the viscosity of the aggregated resin particles gradually lowers, and the form of the aggregated resin particles gradually becomes spherical.

When a solvent having high solubility in water is used as the volatile solvent herein, then the volatile solvent gas may directly lower the viscosity of the aggregated resin particles and, in addition, the volatile solvent having dissolved in water may be absorbed by the aggregated resin particles whereby the solvent shall indirectly lower the viscosity of the aggregated resin particles, and, as a result, the form of the aggregated resin particles may be efficiently controlled.

Further, in the step where the volatile solvent gas is jetted into the aggregated resin particles dispersion so as to pass through it, when the gas is jetted into it as its condition having a surface area as large as possible (as small gas bubbles), then the contact efficiency between the gas and the aggregated resin particles and the gas absorption efficiency in water may increase, and the reaction time may be thereby shortened. When the system is stirred under the condition under which the volatile solvent gas may stay in the aggregated resin particles dispersion for a long period of time, then the same effect may also be attained.

For removing the volatile solvent from the aggregated resin particles of which the form has been controlled via the volatile solvent gas, as so mentioned hereinabove, air or an inert gas is applied onto the surface of the aggregated resin particles dispersion and the dispersion is stirred under heat. It is also effective to reduce the pressure in the system so as to lower the boiling point of the volatile solvent.

Next, the toner production method is described concretely.

First, a resin and a colorant are stirred and mixed in an organic solvent, whereby the resin and the colorant are dissolved and/or dispersed therein to give an oily phase.

This step is an initial colorant dispersion step where a predetermined amount of a colorant is added to a toner material solution (oily phase) and then stirred whereby the colorant is dispersed in the solution.

In this, the resin must contain at least a component capable of dissolving in an organic solvent, but its form and size are not specifically defined so far as it can completely dissolve in an organic solvent. Even a resin partly not dissolving in an organic solvent may be employable herein with no specific limitation, so far as it may form a slurry of resin particles having a size of at most about 3 μm. For example, emulsion polymerization and phase-transfer emulsification may be effective for obtaining submicron-size particles. According to the methods, for example, polyester resin and styrene-acrylic resin may be used as a resin material for toner.

Another method is also employable herein, which comprises disrupting resin masses by applying shearing force thereto in a vapor phase or in an aqueous phase. According to the method, various disruptive resins may be used.

For example, herein employable are polyester resins prepared by polycondensation of an alcohol component and a carboxylic acid; polystyrene-acrylic resins prepared by copolymerization of a styrene monomer and an acrylate or methacrylate; polyacrylic acid resins prepared by polymerization of various acrylic acid monomers; polymethacrylate resins prepared by fusion of various methacrylic acid monomers; copolymer resins of acrylate and methacrylate; polyamide resins, polyimide resins, polyurethane resins. These resins may be used herein either singly or as combined.

Preferably, the resin has an acidic functional group at the resin terminal and can be ionized through reaction with a basic compound to be a self-dispersible resin. For example, preferred is a resin having a polar group that becomes anionic when dissociated, such as a carboxyl group or a sulfone group, at the resin terminal. Of the above-mentioned resins, preferred are polyester resins, polystyrene-acrylic resins, polyacrylic acid resins, polymethacrylate resins, and copolymer resins of acrylate and methacrylate.

As the basic compound, herein usable are organic tertiary amines such as triethylamine, tributylamine, dimethylamine, dimethylethanolamine, diethylethanolamine; ammonia; and inorganic bases such as sodium hydroxide, potassium hydroxide.

For the colorant, herein usable are inorganic pigments such as carbon black, magnetite, black titanium oxide; organic pigments such as resin-modified azine compounds; and other oil-soluble dyes. The organic solvent for use herein may be any one that may dissolve a resin and is insoluble or hardly soluble in water. Concretely, for example, it includes methyl ethyl ketone, ethyl acetate, butyl acetate, toluene, benzene, xylene.

Wax or the like that is necessary for toner may be previously added to the oily phase. The wax is not specifically defined, for which, for example, usable are polyolefin wax such as polypropylene wax, polyethylene wax; paraffin wax, Sasol wax; and other modified wax prepared by adding a polar group to the above-mentioned wax.

Next, a dispersion stabilizer and water are added to the oily phase thus formed in the manner as above, and stirred and mixed to give a dispersion where the size of the droplets is fully smaller than a toner particle size.

For the dispersion stabilizer, herein usable are water-soluble resins such as polyvinyl alcohol, polyvinylpyrrolidone; various anionic, cationic and nonionic surfactants; water-insoluble inorganic fine powder having a volume-average particle size of at most 1 μm such as calcium phosphate, calcium carbonate; and, when a resin having an acidic functional group at the resin terminal and capable of ionizing through reaction with a basic compound to be a self-dispersible resin is used, herein usable are compounds that are basic as aqueous solutions thereof, such as sodium hydroxide, potassium hydroxide.

After the droplets dispersion has been formed as in the above, the dispersion is stirred under heat to remove the organic solvent, and a dispersion of droplets-solidified, colorant-containing resin particles is thus formed.

Next formed is a dispersion of aggregated resin particles where the colorant-containing resin particles dispersion is aggregated to those having nearly a toner particle size.

In this step, an aggregating agent is added so as to aggregate the colorant-containing resin particles. When an emulsion aggregation toner is produced, resin particles and also other toner material particles must be aggregated. In general, water-soluble substances or solid particles that have a polarity opposite to the polarity of the surface of an additive (dispersion stabilizer) or a solid substance that has an influence on the dispersion stabilization of material particles dispersed in a slurry may break the stable dispersion condition for particle aggregation. However, the aggregation speed may vary, depending on the type and the amount of the aggregating agent used and on the heating temperature and the stirring condition of the system in the aggregation step, and therefore the best condition for it should be suitably determined.

Concrete examples of the aggregating agent are compounds that are acidic as their aqueous solutions, such as hydrochloric acid, sulfuric acid, nitric acid, acetic acid, aluminium chloride; inorganic oxide particles of from 0.01 to 1 μm in size, such as silicon oxide, aluminium oxide, titanium oxide; and ionic surfactants having an opposite polarity to dispersion stabilization.

After the aggregating agent has been added to the system in the manner as above, a dispersion stabilizer is added thereto. The dispersion stabilizer is added for the reason that, after the solid component in the slurry of resin particles has been aggregated to those having a desired size, the thus-aggregated particles are prevented from being further aggregated and grown, and for the reason that the toner particles are prevented from fusing and aggregating together in the toner form-controlling (resin viscosity-reducing) step. The aggregating agent is not specifically defined so far as it may prevent the aggregation and may stabilize the individual dispersion of each toner particle. Concretely, like those mentioned hereinabove, it includes water-soluble resins such as polyvinyl alcohol, polyvinylpyrrolidone; various anionic, cationic and nonionic surfactants; water-insoluble inorganic fine powder having a volume-average particle size of at most 1 μm such as calcium phosphate, calcium carbonate; and compounds that are basic as aqueous solutions thereof, such as sodium hydroxide, potassium hydroxide.

When a resin having an acidic functional group at the resin terminal and capable of ionizing through reaction with a basic compound to be a self-dispersible resin, for example, a resin having a polar group that becomes anionic when dissociated, such as a carboxyl group or a sulfone group, at the resin terminal is used as so mentioned hereinabove, then the above-mentioned basic compound may be used, including organic tertiary amines such as triethylamine, tributylamine, dimethylamine, dimethylethanolamine, diethylethanolamine; ammonia; and inorganic bases such as sodium hydroxide, potassium hydroxide.

Next, a volatile solvent gas is jetted into the aggregated resin particles dispersion. The volatile solvent acts to control the form of the aggregated resin particles to be from an amorphous form to aspherical form, as so mentioned hereinabove, and its characteristics may satisfy the following: (1) It is volatile; (2) it may at least partially dissolve the resin to be a toner binder; (3) the solvent itself is at least partially soluble in water. For example, it includes methyl ethyl ketone, ethyl acetate, methyl acetate, chloroform. In order that the toner dispersion may readily absorb the volatile solvent gas, a vapor of a water-soluble solvent such as methanol, ethanol, 2-propanol may be suitably mixed with the volatile solvent gas.

According to the illustrative aspects, the volatile solvent gas may be jetted into the aggregated resin particle dispersion while circulated therethrough. It may be jetted thereinto in the form of fine bubbles thereof. The volatile solvent gas is efficiently transferred and introduced into the aggregated resin particles dispersion at room temperature and under normal pressure. The contact efficiency between the aggregated resin particles and the solvent gas is increased. The absorption efficiency of the particles is increased into water to thereby shorten the reaction time.

Next described is a toner production apparatus capable of producing a toner including the above-mentioned aggregated resin particles, with reference to FIG. 1. FIG. 1 is an explanatory view of schematically showing a toner production apparatus.

The toner production apparatus 1 shown in FIG. 1 comprises a first separable flask 2 and a second separable flask 3. The first separable flask 2 is a container where a dispersion of aggregated resin particles is formed, in which resin particles dispersed in an aqueous phase or in a continuous phase of an aqueous solution are aggregated therein. The separable flask 2 of the type is composed of a flask body 2A and a cap 2B formed separably from the flask body 2A.

Below the first separable flask 2, disposed is a water bath WB, and a heater 4 is disposed in the water bath WB. While kept heated by the heater 4, the water bath WB acts to keep the first separable flask 2 at a predetermined temperature.

At the top of the cap 2B, a motor is fixed. A stirring impeller 6 with six blades is connected to the motor 5. When the motor 5 is driven, then the stirring impeller coordinates with the water bath WB and acts to heat and stir the aggregated resin particles dispersion formed in the first separable flask 2.

The second separable flask 3 is a container to be filled with a volatile solvent. Like the first separable flask 2, it is composed of a flask body 3A and a cap 3B formed separably from the flask body 3A.

Between the cap 2B of the first separable flask 2 and the cap 3B of the second separable flask 3, installed is a first connecting duct 7 for connecting the two flask bodies 2A and 3A. One end of the first connecting duct 7 (the end on the side of the flask body 3A) is set at a position spaced upward from the surface (liquid level) of the volatile solvent filled in the flask body 3A; and the other end of the first connecting duct 7 (the end on the side of the flask body 2A) is positioned below the surface (liquid level) of the aggregated resin particles dispersion formed in the flask body 2A.

In the middle of the first connecting duct 7, disposed is a pump 8. The pump 8 sucks up the gas that has been formed through vaporization of the volatile solvent in the second separable flask 3, and jets the volatile solvent gas into the aggregated resin particles dispersion in the first separable flask 2.

Between the cap 2B of the first separable flaks 2 and the cap 3B of the second separable flask 3, installed is a second connecting duct 9 for connecting the two flask bodies 2A and 2B, like in the above. One end of the second connecting duct 9 (the end on the side of the flask body 2A) is set at a position spaced upward from the surface (liquid level) of the aggregated resin particles dispersion in the flask body 2A; and the other end of the second connecting duct (the end on the side of the flask body 3A) is positioned below the surface (liquid level) of the volatile solvent filled in the flask body 3A.

In the middle of the second connecting duct 9, disposed is a circulation unit 10 that comprises a pump, etc. The circulation unit 10 sucks up the volatile solvent gas that has been jetted into the aggregated resin particles dispersion in the first separable flask 2 and that could not be kept dissolving in the dispersion anymore, and circulates the volatile solvent gas into the volatile solvent in the second separable flask 3, as so mentioned hereinabove.

In the toner production apparatus 1, the aggregated resin particles dispersion formed in the first separable flask 2 is heated and stirred by the stirring impeller 6 rotated by the driving force of the motor 5, as coordinated with the water bath WB of which the temperature is controlled by the heater 4. By driving the pump 8, the volatile solvent gas in the second separable flask 3 is jetted into the aggregated resin particles dispersion in the first separable flask 2 via the first connecting duct 7.

In that manner, when a volatile solvent gas is jetted into an aggregated resin particles dispersion and passes through it, the gas is caught by the aggregated resin particles that have high compatibility with it. Accordingly, the viscosity of the aggregated resin particles gradually lowers, and the form of the aggregated resin particles gradually becomes spherical. When a solvent having high solubility in water is used as the volatile solvent herein, then the volatile solvent gas may directly lower the viscosity of the aggregated resin particles and, in addition, the volatile solvent having dissolved in water may be absorbed by the aggregated resin particles whereby the solvent shall indirectly lower the viscosity of the aggregated resin particles, and, as a result, the form of the aggregated resin particles may be efficiently controlled.

The volatile solvent gas that could not be kept dissolving in the aggregated resin dispersion may be sucked up from the first separable flask 2 through the second linking duct 9, by driving the circulation unit 10, and it may be circulated into the second separable flask 3 through the second connecting duct 9.

EXAMPLE

The toner production method according to illustrative aspects is described below.

In the aspect, the following materials are used for toner production.

Resin:

Polyester resin XPE2443 (Mn 4400, MW 81300, Mw/Mn=18.48, gel fraction 17.4%, acid value 2.0 KOH mg/g: produced by Mitsui Chemical).

Pigment:

Carbon black #260 (primary particle size 40 nm, BET specific surface area 70 $m^2/g$, oil absorption 79 ml/100 g, pH 8.0: produced by Mitsubishi Chemical).

Charge Controlling Agent:

N01 (nigrosine-base azine compound, produced by Orient Chemical).

Organic solvent:

Methyl ethyl ketone (first-class grade chemical, produced by Kanto Chemical—hereinafter abbreviated to MEK).

[Formation of Slurry]

225 g of distilled water and 1.7 g of aqueous 1 N sodium hydroxide solution are mixed in a 500-ml beaker, to which is added 180 g of MEK. Further, 45 g of resin (XPE2443), 2.25 g of pigment and 2.25 g of charge-controlling agent are added thereto. Next, this is stirred in a homogenizer DIAX900 (by Heidolph), at 11000 rpm for 20 minutes, then the beaker is dipped in a water bath at 60° C., and while the mixture is heated, the solvent is evaporated away for 90 minutes. The system is mixed with a turbine stirrer with 6 flat blades (ϕ50× 20 mm) at 140 rpm, and the volatile solvent is kept removed from it through a suction duct installed near the beaker mouth. The slurry thus formed (dispersion of particles) is kept spontaneously cooled to 30° C. or lower with stirring.

A part of the slurry thus cooled to 30° C. or lower is analyzed for the solid content concentration in the slurry and for the particle size of the particles therein. In this step, the solid content concentration in the slurry is determined as follows: Concretely, 10 g of the slurry is accurately metered on a shallow aluminium pan, and heated on a hot plate at 150° C. for 2 hours. Then, this is cooled to room temperature, and the weight of water that had been evaporated away from the slurry is accurately metered. The remaining solid content is calculated, and this is divided by the original slurry weight to get the solid content concentration of the slurry.

When the solid content concentration of the slurry is over 20% by weight, then the slurry is diluted with distilled water so as to have a solid content concentration of 20% by weight, and this is used for the formation of aggregated particles.

The particle size of the particles dispersed in the slurry is determined by a laser diffraction-type particle sizer (LA500, by Horiba) after the concentration of the slurry had been controlled to fall within a suitable range.

[Formation of Particles]

First, 80 g of the slurry (having a solid concentration of 20% by weight) and 2 g of aqueous 0.2 N aluminium chloride solution are put into a 100-ml beaker, and stirred with a homogenizer DIAX900 (by Heidolph) at 8000 rpm for 5 minutes. Next, while mixed with 80 g of aqueous SN deformer 777 (by Sannopco), this liquid is fed into the flask body 2A of the first separable flask 2 having a capacity of 200 ml. Further, while ultrasonic waves (28 kHz, 650 W) are applied to the mixed system for 3 minutes, the system was stirred with a plate (20 mm×20 mm) of which one end is fixed, at 120 rpm. Next, the first separable flask 2 is dipped in the water bath WB kept heated at 50° C. via the heater 4, and the motor 5 is driven whereby the mixed system is stirred by the stirring impeller 6 (with 6 blades of ϕ50 mm×20 mm each) at 140 rpm. Further, after 10 minutes after the first separable flask 2 had been dipped in the water bath WB, 4 g of aqueous 0.2 N sodium hydroxide solution is added to the system as an aggregation inhibitor. Further after 30 minutes, the system is heated up to 80° C., taking about 10 minutes, and then this is kept heated as such. When the particle size reached from about 10 to 12 μm, then the heating is stopped. Next, the separable flask 2 is taken out of the water bath WB, and 2 g of aqueous 0.2 N sodium hydroxide solution, as a dispersion stabilizer, is added to it, and ultrasonic waves (28 kHz, 650 W) are applied thereto for 3 minutes by an ultrasonic disperser.

[Form Control]

The first separable flask 2 is dipped in the water bath WB controlled at 20° C. By driving the motor 5, the system is stirred with the stirring impeller (with 6 blades of ϕ50 mm×20 mm each) at 140 rpm. Next, the second separable flask 3 is filled with 120 g of methylethylketone, and this is connected to the first separable flask 2 containing a toner particles dispersion therein, via the first connecting duct 7 having an aeration and circulation function by the pump 8. In this stage, the toner dispersion is kept stirred as so mentioned in the above, and a volatile solvent gas is jetted into it via 10 holes of ϕ2 mm each formed at the end of the first connecting duct 7 on the side of the first separable flask 2. In this stage, aeration is started at an airflow rate of about 1.5 liters/min via the pump 8 and the circulation unit 10, whereby the volatile solvent gas is circulated through the system. The dispersion is suitably sampled, and the form change of the toner particles in the samples is monitored, and when the form of the toner particles became the intended one, then the circulation of the volatile solvent gas is stopped.

The form change of the toner particles, depending on the time for circulation of the volatile solvent gas, is described with reference to FIG. 2. FIG. 2 shows how the form of the toner particles changes depending on the volatile solvent gas circulation time.

Figure 2A:
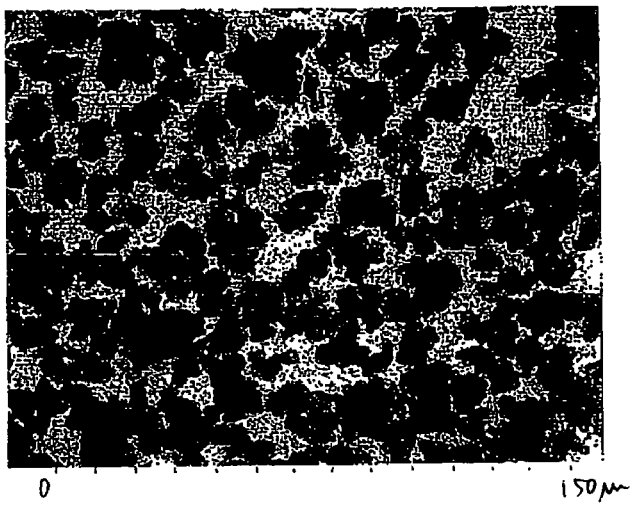
FIG. 2A shows toner particles before circulation of the volatile solvent gas.

FIG. 2A shows a form of the toner particles before circulation of the volatile solvent gas, in which it is understood that amorphous, aggregated resin particles remain as they are, as is obvious from the form of the toner particles therein. The system is heated from the condition of FIG. 2A up to 95° C., but no change is found in the form of the toner particles after the heating.

Figure 2B:
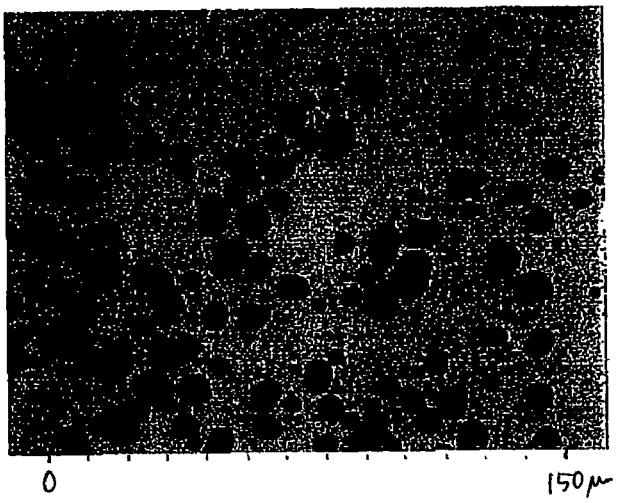
FIG. 2B shows toner particles after circulation of the volatile solvent gas for about 60 minutes.

FIG. 2B shows toner particles after circulation of the volatile solvent gas for about 60 minutes, in which it is understood that the amorphous toner particles significantly changed to spherical particles.

Figure 2C:
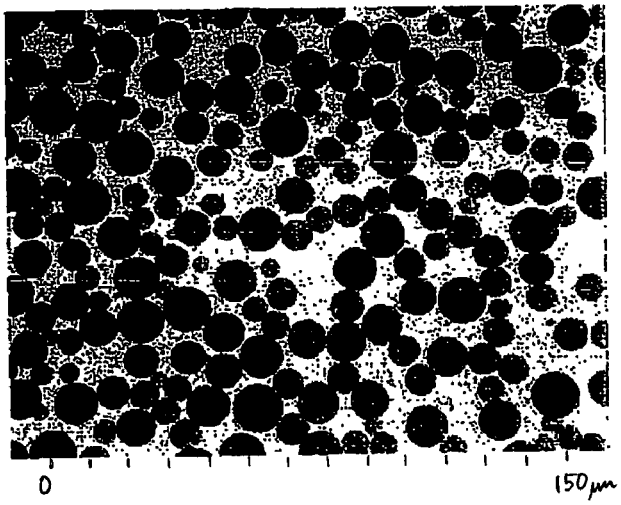
FIG. 2C shows toner particles after circulation of the volatile solvent gas for about 90 minutes.

Further, FIG. 2C shows the toner particles after circulation of the volatile solvent gas for about 90 minutes, in which it is understood that almost all the toner particles changed to spherical particles.

In the manner as above, the form of the toner particles may be changed, depending on the time for circulation of the volatile solvent gas, and they may be changed to nearly spherical particles.

Finally, the cap 2B of the first separable flask 2 containing the toner dispersion therein is removed, and air (or inert gas) is applied onto the surface of the dispersion. Next, the dispersion system is heated at 60° C. and stirred for 1 h our with removing methyl ethyl ketone by vaporization, and then, after 1 hour, the toner dispersion is cooled to 30° C. or lower, filtered and dried to obtain toner particles.

As described hereinabove, the invention may provide a toner production method in which the form of the toner to be produced can be controlled to any desired form of from an amorphous form to a spherical form, efficiently and at low costs according to a simple operation even when a high-viscosity resin or a high-melting-point resin is used as a toner binder, and may provide a toner and a toner production apparatus.

According to the above-illustrative aspects, the volatile solvent is at least partially soluble in water. The volatile solvent gas may be jetted into the aggregated resin particles dispersion while circulated therethrough.

According to the above-illustrative aspects, the volatile solvent gas may be jetted into it in the form of fine babbles thereof. The resin has an acid group at the resin terminal and can be ionized through reaction with a basic compound to be a self-dispersible resin, and a compound of which the aqueous solution is basic and which is a dispersion stabilizer for the aggregated resin particles is added to it.

According to the above-illustrative aspects, the toner production apparatus further comprises a second connecting duct for connecting the first container and the second container, and a circulation unit installed in the second connecting duct, wherein the volatile solvent gas jetted into the aggregated resin particles dispersion in the first container is circulated to the second container via the circulation unit and the second connecting duct.

According to the above-illustrative aspects, the form of the toner to be produced can be controlled to any desired form of from an amorphous form to a spherical form, efficiently and at low costs according to a simple operation even when a high-viscosity resin or a high-melting-point resin is used as a toner binder. The toner produced according to the toner production method and in the toner production apparatus can be used in various applications.

What is claimed is:

1. A toner production method comprising:

jetting a volatile solvent gas into a dispersion of aggregated resin particles where at least resin particles dispersed in a continuous phase are aggregated, controlling a form of the aggregated resin particles by jetting the volatile solvent gas into the dispersion of aggregated resin particles, and removing the volatile solvent from the form-controlled aggregated resin particles.

2. The toner production method according to claim 1, wherein the volatile solvent is at least partially soluble in water.

3. The toner production method according to claim 1, wherein the volatile solvent gas is jetted into the aggregated resin particles dispersion while the volatile solvent gas is circulated through the aggregated resin particles dispersion.

4. The toner production method according to claim 1, wherein the volatile solvent gas is jetted into the aggregated resin particles dispersion in a form of bubbles.

5. The toner production method according to claim 1, wherein the resin has an acid group at terminal of the resin, wherein the resin can be ionized through reaction with a basic compound to be a self-dispersible resin, and wherein a compound of which a aqueous solution is basic as a dispersion stabilizer for the aggregated resin particles is added to the aggregated resin particles dispersion.

* * * * *